US005290030A

United States Patent [19]

Medbury

[11] Patent Number: 5,290,030

[45] Date of Patent: Mar. 1, 1994

[54] CUE STICK

[75] Inventor: Seward J. Medbury, West Bloomfield, Mich.

[73] Assignee: MGX, Inc., Zelienople, Pa.

[21] Appl. No.: 893,746

[22] Filed: Jun. 5, 1992

[51] Int. Cl.[5] ..... A63D 15/08

[52] U.S. Cl. ..... 473/47; 473/2

[58] Field of Search ..... 273/68, 69, 70, 23, 273/2

[56] References Cited

U.S. PATENT DOCUMENTS

| | | | |
|---|---|---|---|
| 298,111 | 5/1884 | Morse . | |
| 364,680 | 6/1887 | Sherwood | 273/68 |
| 370,911 | 10/1887 | Weber . | |
| 507,471 | 10/1993 | Barger | 273/68 |
| 529,731 | 11/1894 | Gschwendtner | 273/68 |
| 608,457 | 8/1898 | Hutzel | 273/68 |
| 692,970 | 2/1902 | Zaehringer | 273/68 |
| 784,090 | 3/1905 | Whitehouse et al. | 273/68 |
| 829,749 | 8/1906 | Adorjan | 273/68 |
| 835,489 | 11/1906 | Adorjan | 273/68 |
| 861,158 | 7/1907 | Bucknum | 273/68 |
| 935,218 | 9/1909 | Moore | 273/68 |
| 1,092,189 | 4/1914 | Varian . | |
| 1,145,127 | 7/1915 | Dunnebacke et al. . | |
| 1,280,876 | 10/1918 | Seenan | 273/68 |
| 1,522,321 | 1/1925 | Nyhagon | 273/68 |
| 1,527,748 | 2/1925 | Rambow | 273/68 |
| 1,560,456 | 11/1925 | Wolpert | 273/68 |
| 1,664,971 | 4/1928 | Dean | 273/68 |
| 1,688,911 | 10/1928 | Wolpert | 273/68 |
| 1,702,292 | 2/1929 | Barrett | 273/68 |
| 1,705,353 | 3/1929 | Barrett | 273/68 |
| 2,028,291 | 1/1936 | MacPherson . | |
| 2,257,326 | 9/1941 | Blum | 273/68 |
| 2,379,006 | 6/1945 | Johnson | 273/72 R |
| 3,103,359 | 9/1963 | Gentile, Jr. | 273/68 |
| 3,332,613 | 7/1967 | Morse | 273/68 |
| 3,342,489 | 9/1967 | Waldo | 273/68 |
| 3,372,929 | 3/1968 | Mollis | 273/68 |
| 3,372,932 | 3/1968 | Molis | 273/68 |
| 3,468,538 | 9/1969 | Johnson | 273/68 |
| 3,534,959 | 10/1970 | Elswick | 273/68 |
| 4,147,346 | 4/1979 | Gianetti | 273/23 |
| 4,215,859 | 8/1980 | Charlton | 273/23 |
| 4,231,574 | 11/1980 | Williams | 273/68 |
| 4,949,964 | 8/1990 | Jolly | 273/68 |
| 5,062,636 | 11/1991 | Rahn . | |

FOREIGN PATENT DOCUMENTS

| | | | |
|---|---|---|---|
| 343506 | 11/1921 | Austria | 273/23 |
| 362721 | 10/1922 | Austria | 273/23 |
| 8849 | of 1885 | United Kingdom | 273/68 |

*Primary Examiner*—Mark S. Graham

*Attorney, Agent, or Firm*—Webb, Burden, Ziesenheim & Webb

[57] ABSTRACT

A cue having a hollow cylindrical handle and a hollow cylindrical shaft with a constant external diameter. A tip member fixed to one end of the shaft and a connector fixed to the other end of the shaft. A butt member fixed to one end of the handle and a connecting member fixed to the other end of the shaft to connect the handle to the shaft. An adjustable weight is located in the hollow handle and a bridge sleeve surrounds the shaft. The bridge sleeve has a bushing at each end with an inner diameter slightly greater than the outer diameter of the shaft so that the shaft can slide through the bridge sleeve to cause a steady movement of the cue.

16 Claims, 2 Drawing Sheets

CUE STICK

BACKGROUND OF THE INVENTION

1. Field of the Invention

The present invention relates generally to a billiard cue or a pool cue and more particularly to a cue which is provided with an adjustable weight in the handle and a bridge sleeve slideably mounted on the shaft.

2. Description of Prior Art

Multipart billiard cues and pool cues have a shaft with an end connected to an end of a handle by a threaded connecting arrangement. A butt member is located at the distal end of the handle and a replaceable tip for contacting a ball is located at the distal end of the shaft. A slideable bridge sleeve may be located around the shaft of the cue to permit movement of the shaft relative to the sleeve. The player holds the bridge sleeve in a stationary position with one hand and grasps the handle of the cue with the other hand to slide the cue laterally along its axis through the stationary bridge sleeve. The bridge sleeve provides a straight and steady movement of the cue and enables the player to contact a ball with greater accuracy than is possible when the player's hand is used to form the bridge. A cue may have a weight in the handle which is adjusted for the individual player when the cue is purchased.

SUMMARY OF THE INVENTION

The present invention is a metal or plastic cue having a hollow cylindrical handle which has one end threadedly connected to an end of a hollow cylindrical shaft. The shaft has a substantially constant outer diameter throughout its length and an annular flange is located at each end of the shaft. A bridge sleeve is slideably mounted on the shaft to permit relative sliding movement between the shaft and the sleeve. The diameter of the bridge sleeve is greater than the outer diameter of the shaft and a bushing is located within each end of the sleeve to contact the outer surface of the shaft and provide for smooth movement of the shaft through the sleeve. The bushings may be made of a hard synthetic material to provide for easy sliding movement of the shaft and to resist wear caused by the movement of the shaft through the bridge sleeve. The substantially constant outer diameter of the shaft is important since the bushings in the ends of the bridge sleeve have a constant inner diameter and the full length of the shaft must slide coaxially through the bushings.

The bridge sleeve forms a more efficient bridge than a player's fingers since it does not change in shape during a cue stroke. Also, perspiration has no effect on a shot when the bridge sleeve is used since the shaft does not stick during a stroke. The bridge sleeve causes the cue tip to contact a ball with improved accuracy which results in a more accurate shot such as when the player imparts a spin to the ball.

An adjustable weight is provided in the hollow handle of the cue. The amount of the weight and its location along the axial length of the handle are selected in accordance with the desire of the player.

A bridge bracket is provided to support the bridge sleeve on a rail of a pool table or a billiard table.

The above as well as other features and advantages of the present invention will become more apparent when reference is made to the detailed specification set forth hereinafter when read with the accompanying drawings wherein like reference characters refer to like parts throughout.

DETAILED DESCRIPTION OF THE PREFERRED EMBODIMENTS

Figure 1:
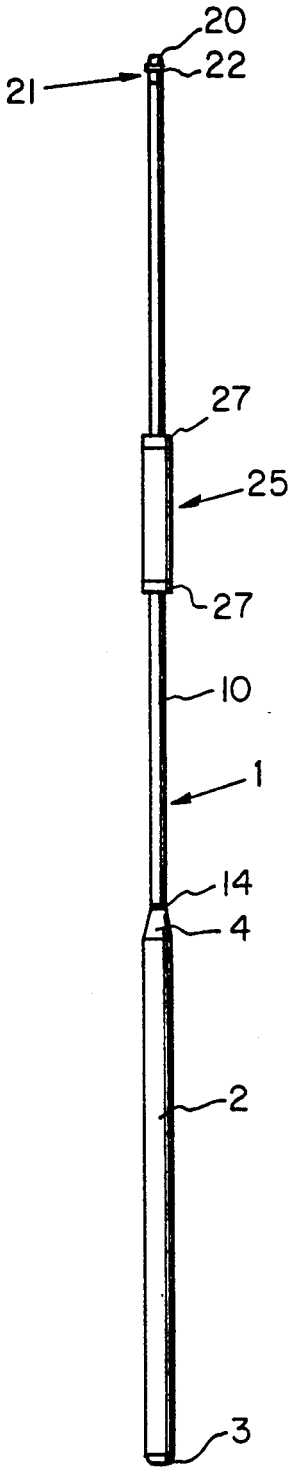
FIG. 1 is an elevation of a cue according to the invention.
Figure 2:
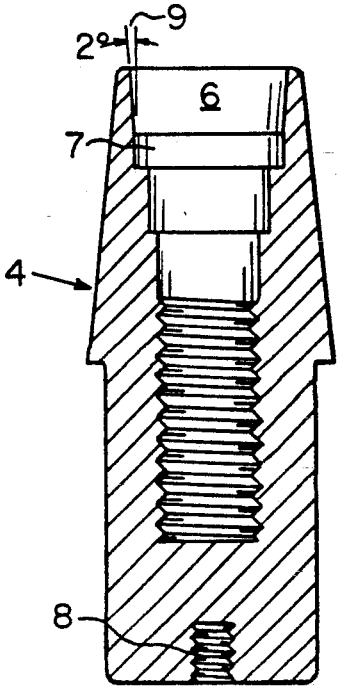
FIG. 2 is a longitudinal section through a connecting member on one end of the cue handle.

With reference to FIG. 1 of the drawings, it will be seen that the cue 1 of the invention has an elongated hollow cylindrical handle 2 with a rubber butt member 3 fixed at one end. The other end of handle 2 receives a connecting member 4 as shown in FIG. 2 of the drawings which is held therein by a friction fit between the inner wall of the hollow handle and the outer surface of the cylindrical portion 5 of the connecting member. An internally threaded blind bore 6 having a chamfered entrance end and a stepped interior 7 is located in one end of connecting member 4 and a second internally threaded blind bore 8 is located in the other end of connecting member 4. The chamfered entrance end of blind bore 6 in the connecting member is formed at a 2° angle 9 with a cylinder having an axis on the longitudinal axis of the connecting member.

Figure 3:
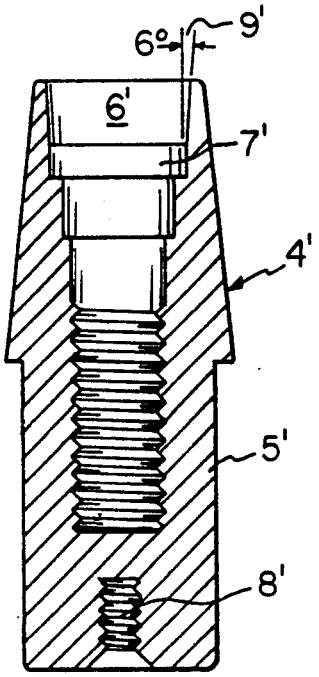
FIG. 3 is a longitudinal section through a modified connecting member as shown in FIG. 2.

The modified connecting member shown in FIG. 3 of the drawings has a 6° angle 9' with a cylinder having an axis on the longitudinal axis of the connecting member.

Figure 8:
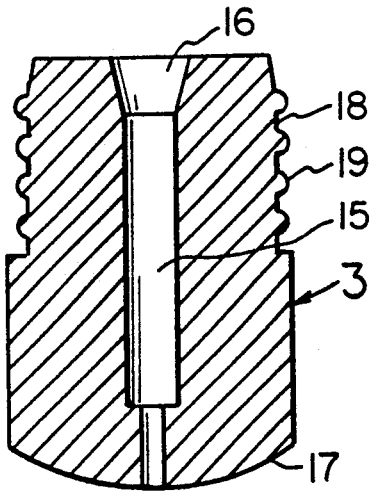
FIG. 8 is a longitudinal section through the butt member on an end of the cue handle.

The butt member 3 shown in FIG. 8 of the drawings has an elongated axial bore 15 to receive one end of an externally threaded weight support rod. The entrance end of bore 15 is chamfered at 16 to guide the end of the rod into the bore. The end 17 of butt member 3 opposite chamfer 16 is smoothly rounded. A reduced diameter portion 18 is formed on the one end of butt member 3 to fit into an open end of handle 2. A plurality of annular ridges 19 are formed on the exterior surface of reduced diameter portion 18 to firmly retain the butt member in handle 2.

Figure 4:
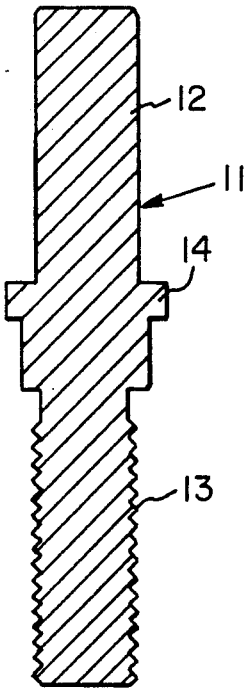
FIG. 4 is a longitudinal section through the connector on an end of the cue shaft.

The cylindrical shaft 10 of cue 1 is hollow and has substantially constant inner and outer diameters throughout its length. A connector 11 shown in FIG. 4 of the drawings is fixed in one end of hollow shaft 10 by a friction fit between the inner surface of the shaft and the outer surface of a cylindrical contact portion 12 of the connector. Connector 11 has an externally threaded portion 13 on the side of an annular flange 14 opposite contact portion 12. The external threads on extension 13 thread into the internal threads in the lower end of blind bore 6 in connecting member 4 and flange 14 on connector 11 fits into stepped entrance end 7 of blind bore 6 in connecting member 4. A resilient cue tip 20 is held on the distal end of shaft 10 in a blind bore in a tip member 21 fixed on the shaft. The tip is a purchased item well known to those skilled in the art and forms no part of the present invention. Tip member 21 has an annular flange 22 for a purpose to be described hereinafter.

The cue handle and shaft can be made of a metal such as aluminum or of a synthetic material such as high-density polyethylene, styrene-butadiene copolymers, cast or molded epoxy resins, acrylic acid polymers such as polymethylmethacrylate or injection-molded polyurethane.

Figure 5:
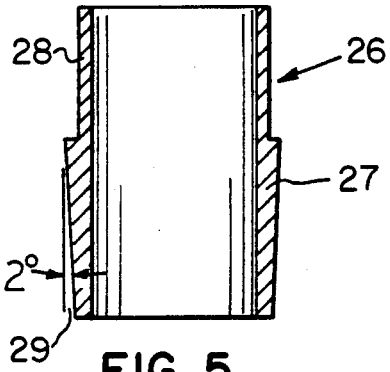
FIG. 5 is a longitudinal section through a bushing for the bridge sleeve.

A cylindrical bridge sleeve 25 surrounds shaft 10 of cue 1 as shown in FIG. 1 of the drawings. The bridge sleeve has a cylindrical bushing 26, as shown in FIG. 5 of the drawings, at each end. Each bushing has a collar 27 which is located exteriorly of and in contact with an end of bridge sleeve 25 shown in FIG. 2 of the drawings and a reduced diameter portion 28 which extends into the bridge sleeve. A taper having a 2° angle 29 is formed between the outer surface of collar 27 and a cylinder having an axis on the longitudinal axis of the bushing for a purpose to be described hereinafter. The outer surface of the reduced diameter portion of each bushing 26 fits tightly within the bridge sleeve to hold the bushing in place by means of a friction fit and extends a substantial distance along the axial length of the bridge sleeve to permit shaft 10 of cue 1 to slide along the inner annular surfaces of the bushings while maintaining the coaxial position of the shaft within the bridge sleeve. The bushings 26 may be made from Delrin which is the trade name for a polyoxymethylene-type acetal resin having good strength and wear resistance. The inner surface of each bushing is smooth to permit the shaft to slide through the bridge sleeve without binding.

Figure 6:
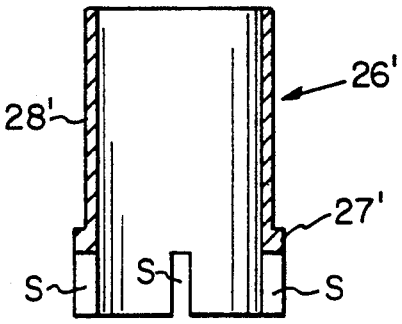
FIG. 6 is a longitudinal section through a modified bushing for the bridge sleeve as shown in FIG. 5.

A modified bushing 26' is shown in FIG. 6 of the drawings. Bushing 26' has a collar 27' located exteriorly of and in contact with the end of a bridge sleeve 25 as shown in FIG. 2 of the drawings and a reduced diameter portion 28' which extends into the bridge sleeve and holds the bushing in place by a friction fit between the outer surface of portion 28' and the inner surface of the bridge sleeve. Bushing 26' has longitudinal slots S radially spaced 90° around the periphery of collar 27' to permit the collar to collapse inwardly radially by a small amount when force is applied to the outer surface of the collar for a purpose described hereinafter.

Figure 7:
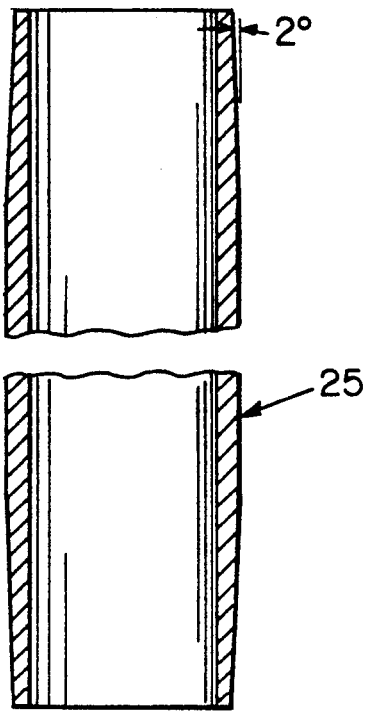
FIG. 7 is a longitudinal section through a modified bridge sleeve.

A modified bridge sleeve 25' is shown in FIG. 7 of the drawings. This bridge sleeve has an inner taper at each end. The taper forms a 2° angle between the outer surface of the bridge sleeve and a cylinder having its axis on the longitudinal axis of the bridge sleeve. The bridge sleeve 25' is utilized with the connecting member 4 shown in FIG. 2 of the drawings. The reason that bridge sleeve 25' is used with the connecting member shown in FIG. 2 is that the 2° external taper on the connecting member cooperates with the 2° internal chamfer 9 on the entrance end of blind bore 6 on bridge sleeve 4 to firmly hold the bridge sleeve in the connecting member when the person using the cue does not want to use the bridge sleeve.

Bridge sleeve 25, shown in FIG. 1 of the drawings, is used with slotted bushings 26' shown in FIG. 6 of the drawings when connecting member 4' shown in FIG. 3 of the drawings is inserted in an end of handle 2. The reason that bushings 26' are used with connecting member 4' is that the 6° chamfer at the open end of threaded blind bore 6' receives the end of the slotted bushing and continued longitudinal force on the bridge sleeve in the direction of handle 2 will cause the slotted end of collar 27' to collapse inwardly until a force fit is achieved between the exterior surface of the collar and the chamfered end of blind bore 6.

Figure 9:
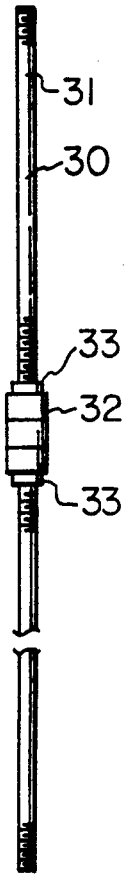
FIG. 9 is an elevation of adjustable weight discs in the hollow cue handle.

A rod 30 having external threads 31 throughout its length is located coaxially in the hollow cylindrical handle of cue 1. One end of rod 30 is threaded into the internal threads in blind bore 6 in connecting member 4 or 4' and the other end of rod 30 is fitted into axial blind bore 15 in butt member 3 of the cue. As shown in FIG. 9 of the drawings, a plurality of separate weight discs 32 having centrally located holes therethrough are aligned along rod 30 and are held in place by adjustment nuts 33 threaded on threads 31 at opposite sides of the aligned weight discs. The number of weight discs and their location along rod 30 are selected according to the comfort of the player using the cue. After the end of rod 30 is threaded into internal threads 7 in connecting member 4, butt member 3 is placed on the end of handle 2 and the free end of rod 30 is received in blind bore 15. Should it be desirable to change the location of the weight discs or to add or remove weight discs, the butt member is removed from the end of the handle and rod 30 is unscrewed from threaded blind bore 8 in the connecting member. Rod 30 is removed from handle 2 to expose the weight discs and the adjustment nuts.

Figure 10:
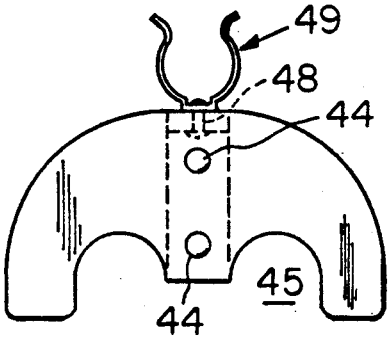
FIG. 10 is a rear view of a bridge sleeve support bracket.
Figure 11:
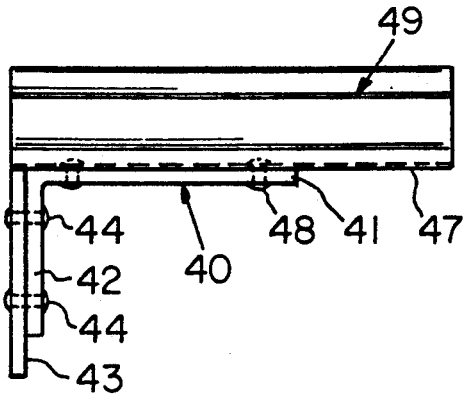
FIG. 11 is a side elevation of the bracket shown in FIG. 10.

FIGS. 10 and 11 of the drawings show a bridge sleeve support bracket 40 having a member 41 adapted to lie over a rail of a pool table or a billiard table. A kidney-shaped end plate 43 with cutouts 45 is attached to a vertical leg 42 of bracket 40 by set screws or rivets 44 or other attachment means. Set screws or rivets 48 attach the base 47 of a spring clip 49 to the leg 41 of bracket 40. The upwardly extending arms of spring clip 49 receive a bridge sleeve when bracket 40 is placed over a rail of a pool table or a billiard table. Thus, the spring clip replaces the player's hand to support the bridge sleeve.

In operation, the bridge sleeve is held in the player's hand or, alternatively, is positioned in the clip of the bridge sleeve bracket shown in FIGS. 10 and 11 of the drawings. When the bridge sleeve is held in a stationary position by the player or the bracket, the player pulls back on the handle and the bridge sleeve supports the shaft of the cue. The player then moves the handle of the cue forwardly to move tip 20 toward the ball to be struck by the tip. The flange 14 on connector 13 serves as a stop against which the end of the collar of the rear bushing of the bridge sleeve will come to rest when the handle is in the forward position. The end of the collar of the forward bushing contacts flange 22 on tip member 21 when the handle is in the rearward position.

The foregoing describes preferred embodiments of the invention and is given by way of example only. The invention is not limited to any of the specific features described herein, but includes all such variations thereof within the scope of the appended claims.

I claim:

1. A cue for playing pocket pool or billiards comprising a hollow elongated handle having a first end and a second end and a hollow elongated shaft having a first end and a second end, said handle and said elongated shaft being substantially cylindrical in cross section and said elongated shaft having a substantially constant external diameter, a tip member fixed to said first end of said elongated shaft and a connector fixed to said second end of said elongated shaft, a butt member fixed to said first end of said handle and a connecting member fixed to said second end of said handle, weight means located within said hollow handle, means for adjustably locating said weight means along the longitudinal axis of said hollow handle according to the desire of a player and bridge means including a cylindrical sleeve and a bushing at each end of said cylindrical sleeve surrounding said elongated shaft and having an inner diameter slightly in excess of the outer diameter of said elongated shaft, each of said bushings having an elongated outer portion with a reduced diameter located within an end of said sleeve and a collar portion having an outer diameter greater than said reduced diameter of said elongated outer portion forming a shoulder contacting an end of said sleeve, whereby a player holds said bridge means stationary while sliding said elongated shaft through said bridge means to cause a steady and accurate movement of said tip member.

2. A cue as set forth in claim 1 wherein said means for adjustably locating said weight means is a threaded rod extending throughout the length of said handle from said connecting member to said butt member and wherein said weight means is a plurality of discs having opposed faces perpendicular to the axis of said rod slideably mounted on said rod and a nut threaded on said rod adjacent to each face of said weight discs to adjust the position of said weight discs along the length of said rod and to hold said weight discs in said adjusted position.

3. An apparatus as set forth in claim 1 wherein said tip member has an annular shoulder formed thereon and said connector has an annular shoulder formed thereon, whereby said annular shoulders define the extent of the movement of said shaft relative to said bridge means when said shaft is moved through said bridge means.

4. A cue as set forth in claim 1 wherein at least one of said handle and said shaft is formed of aluminum.

5. A cue as set forth in claim 1 in combination with a bridge bracket having a first leg and a second leg connected to said first leg to form a right angle, a plate attached to said first leg and holding means for said bridge sleeve attached to said second leg, whereby said holding means receives said bridge means to maintain said bridge means in a stationary position.

6. A combination set forth in claim 5 wherein said holding means is a spring clip having a base portion connected to said second leg of said bridge bracket and spaced resilient arms extending upwardly from said base portion to receive said bridge means.

7. A cue as set forth in claim 1 wherein said connecting member has a stepped end and said stepped entrance end has an outer chamfer at the open end and said collar portion of said ;bushing has a plurality of elongated longitudinal slots, whereby said collar portion of said bushing fits into said outer chamfer to hold said cylindrical sleeve in position in said connecting member.

8. A cue as set forth in claim 7 wherein said outer chamfer forms a 6° angle with a cylinder having an axis on the axis of said sleeve.

9. A cue as set forth in claim 1 in combination with a bridge bracket having a resilient spring clip holding said bridge means, whereby said bridge means remains stationary when said elongated shaft of said cue is moved through said bridge means.

10. A cue for playing pocket pool or billiards comprising a hollow elongated handle having a first end and a second end and a hollow elongated shaft having a first end and a second end, said handle and said elongated shaft being substantially cylindrical in cross section and said elongated shaft having a substantially constant external diameter, a butt member fixed to said first end of said handle and a connecting member fixed to said second end of said handle, said connecting member including a first end having an internally threaded blind bore and a stepped opening and a second end having an internally threaded blind bore adapted to receive the threaded end of a rod located within said hollow handle, weight means located within said hollow handle, means for adjustably locating said weight means along the longitudinal axis of said handle according to the desire of a player, a tip member fixed to said first end of said elongated shaft and a connector fixed to said second end of said elongated shaft, said connector including a contact portion on one end having an outer surface located within an end of said hollow elongated shaft and in frictional contact with the inner surface of said hollow elongated shaft, an annular flange on said connector adjacent said contact portion and an externally threaded extension on the end of said connector opposite said one end having said contact portion in threaded engagement with said internally threaded blind bore in said first end of said connecting member and bridge means surrounding said elongated shaft, said bridge means having an inner diameter slightly in excess of the outer diameter of said elongated shaft whereby a player holds said bridge means stationary while sliding said elongated shaft through said bridge means to cause a steady and accurate movement of said tip member.

11. A cue as set forth in claim 10 including bore in said butt member, an elongated externally threaded rod having a first end threaded into said internally threaded blind bore in said second end of said connecting member and a second end threaded located in said bore in said butt member, weight means located on said rod and means for adjusting the position of said weight means along the length of said rod, whereby said weight means is positioned along said rod in said handle in accordance with the desire of the layer using said cue.

12. The combination of a cue and a bridge bracket, said cue comprising a hollow substantially cylindrical elongated hollow handle having a first end and a second end and a substantially cylindrical elongated shaft having a first end and a second end and a substantially constant external diameter, a tip member fixed to said first end of said shaft and a connector fixed to said second end of said shaft, a butt member fixed to said first end of said hollow handle and a connecting member fixed to said second end of said hollow handle, an adjustable weight means located in said hollow handle for longitudinal movement along the length of said hollow handle, bridge means surrounding said shaft and having an inner diameter slightly in excess of the external diameter of said shaft, said bridge means including a cylindrical sleeve and a cylindrical bushing located at each end of said cylindrical sleeve, each of said bushings having an elongated reduced diameter portion located within an end of said sleeve and a collar having an outer diameter greater than said reduced diameter portion to form a shoulder contacting an end of said cylindrical sleeve and a bridge bracket adapted to fit over a rail of a pool table, said bridge bracket including a first leg and a second leg attached at a right angle to said first leg, resilient means on said second leg of said bridge bracket for holding said bridge means in a stationary position while sliding said shaft through said bridge means to cause a steady and accurate movement of said tip member relative to a ball.

13. The combination set forth in claim 12 including a threaded rod extending throughout the length of said handle from said connecting member to said butt member and wherein said adjustable weight means is a plurality of discs slideably mounted on said rod and a nut threaded on said rod adjacent to opposite sides of said discs to adjust the position of said discs along the length of said rod and to hold said discs in an adjusted position.

14. The combination set forth in claim 12 wherein said connecting member has an axial internally threaded bore and said connector includes a smooth surface contact portion adapted to fit within and contact the inner surface of said hollow shaft, a shoulder on said connector adjacent said contact portion and an externally threaded end on said connector on the end of said shoulder opposite said contact portion, whereby said externally threaded end of said connector screws into said internally threaded bore in said connecting member on said handle.

15. The combination set forth in claim 14 including an elongated externally threaded rod having a first end threaded into said threaded bore in said second end of said connector and a second end held in said butt member, said adjustable weight means located on said rod and means for adjusting the position of said adjustable weight means along the length of said rod, whereby said adjustable weight means is positioned in said handle in accordance with the desire of a player using said cue.

16. A cue for playing pocket pool or billiards comprising a hollow elongated handle having a first end and a second end and a hollow elongated shaft having a first end and a second end, said handle and said elongated shaft being substantially cylindrical in cross section and said elongated shaft having a substantially constant external diameter, a tip member fixed to said first end of said elongated shaft and a connector fixed to said second end of said elongated shaft, a butt member fixed to said first end of said handle and a connecting member fixed to said second end of said handle, weight means located in said hollow handle, means for adjustably locating said weight means along the longitudinal axis of said handle according to the desire of a player and bridge means surrounding said elongated shaft and having an inner diameter slightly in excess of the outer diameter of said elongated shaft, said bridge means is an elongated hollow cylindrical sleeve having spaced ends and the external surface of each of said spaced ends is formed with an inner angled taper, and said connecting member has a stepped entrance end formed with an inner surface formed with an outer angled taper for receiving said second end of said shaft, whereby said inner angled taper on an end of said cylindrical sleeve fits in said outer angled taper on said stepped entrance end of said connecting member to frictionally hold said cylindrical sleeve in said connecting member.

* * * * *

UNITED STATES PATENT AND TRADEMARK OFFICE

CERTIFICATE OF CORRECTION

PATENT NO. : 5,290,030
DATED : March 1, 1994
INVENTOR(S) : Seward J. Medbury

It is certified that error appears in the above-indentified patent and that said Letters Patent is hereby corrected as shown below:

Claim 7 Line 53 Column 5 "stepped end and" should read --stepped entrance end and--.

Claim 7 Line 55 Column 5 ";bushing" should read --bushing--.

Claim 11 Line 33 Column 6 before "bore" insert --a--.

Claim 11 Line 37 Column 6 after "second end" delete "threaded".

Claim 11 Line 42 Column 6 "layer" should read --player--.

Signed and Sealed this

Twenty-seventh Day of September, 1994

*Attest:*

Bruce Lehman

BRUCE LEHMAN

*Attesting Officer*

*Commissioner of Patents and Trademarks*